US007722048B2

(12) United States Patent
Smith et al.

(10) Patent No.: US 7,722,048 B2
(45) Date of Patent: May 25, 2010

(54) MINI-HOLD 'EM GAMES

(76) Inventors: Ray Smith, 546 E. Curtis St., Linden, NJ (US) 07036; Amanda Tears Smith, 546 E. Curtis St., Linden, NJ (US) 07036

( * ) Notice: Subject to any disclaimer, the term of this patent is extended or adjusted under 35 U.S.C. 154(b) by 0 days.

(21) Appl. No.: 12/151,320

(22) Filed: May 5, 2008

(65) Prior Publication Data

US 2009/0008877 A1 Jan. 8, 2009

Related U.S. Application Data

(60) Provisional application No. 60/927,854, filed on May 7, 2007.

(51) Int. Cl.
*A63F 1/00* (2006.01)

(52) U.S. Cl. ..... 273/292; 273/274; 463/13

(58) Field of Classification Search ..... 273/292, 273/274, 309; 463/13, 12
See application file for complete search history.

(56) References Cited

U.S. PATENT DOCUMENTS

| | | | | |
|---|---|---|---|---|
| 4,836,553 | A | 6/1989 | Suttle et al. | 273/292 |
| 5,288,081 | A | 2/1994 | Breeding | 273/292 |
| 5,494,295 | A | 2/1996 | Potter et al. | 273/292 |
| 5,685,774 | A | 11/1997 | Webb | 463/13 |
| 5,697,614 | A | 12/1997 | Potter et al. | 273/292 |
| 6,012,719 | A | 1/2000 | Webb | 273/292 |
| 6,206,373 | B1 | 3/2001 | Garrod | 273/292 |
| 6,481,719 | B2 | 11/2002 | Webb | 273/292 |
| 6,523,831 | B2 | 2/2003 | Webb | 273/292 |
| 6,637,747 | B1 | 10/2003 | Garrod | 273/292 |
| 2002/0195775 | A1 | 12/2002 | Webb et al. | 273/292 |
| 2004/0061288 | A1 | 4/2004 | Snow | 273/274 |
| 2004/0217548 | A1 | 11/2004 | Snow | 273/292 |
| 2005/0082760 | A1 | 4/2005 | Yoseloff et al. | 273/292 |
| 2005/0242506 | A1 * | 11/2005 | Yoseloff | 273/292 |
| 2005/0269775 | A1 * | 12/2005 | Sorge | 273/274 |
| 2006/0119044 | A1 * | 6/2006 | Kekempanos et al. | 273/292 |
| 2006/0267285 | A1 | 11/2006 | Webb et al. | 273/292 |
| 2007/0075496 | A1 * | 4/2007 | Roethel | 273/292 |

* cited by examiner

*Primary Examiner*—Benjamin H Layno
(74) *Attorney, Agent, or Firm*—Mark A. Litman & Associates, PA

(57) ABSTRACT

A playing card wagering game has a player hand compete against another player hand according to three-card poker rank or a player hand compete against a dealer hand. At least one or two players place a first wager on the card wagering game and an optional second side bet wager. The player hand begins with two respective hole cards and all player hands are completed with community playing cards dealt in sets of cards. Relative rank of the players' hands is determined. The first wager is resolved based upon the determined relative rank by determining which player hand(s) wins. The second wager is resolved according to rules that comprise comparing rank of each player's hand to a paytable.

22 Claims, 2 Drawing Sheets

Single Player Layout

6 Player Table Layout

MINI-HOLD 'EM GAMES

RELATED APPLICATIONS DATA

This application claims priority from U.S. Provisional Application Ser. No. 60/927,854, filed 7 May 2007.

BACKGROUND OF THE INVENTION

1. Field of the Invention

The present invention relates to the field of casino wagering, casino card game wagering, and particularly casino table card game wagering.

2. Background of the Invention

Many different wagering games presently exist for use in both home and casino environments. Such games should necessarily be exciting, not excessively complicated, and relatively easy to learn so as to avoid frustrating the players. Poker games in particular have gained widespread popularity because of their well-known rules and long-established ranking of hands.

Furthermore, the games usually involve numerous wagering opportunities for the players, thus increasing player participation and excitement. Lastly, the games move fairly quickly, which enhances player interest. All of these factors have created games that are widely accepted and widely known. Consequently, further variations of wagering games are desired.

Poker games in general reward players for poker hands that beat the dealer's hand. Other poker games have wagering events or bonus events in which a particularly high-ranking poker hand receives a bonus or jackpot. Some poker games combine both player versus dealer competition and competition against a paytable at the same time. Examples of such games include Three-Card Poker® games (e.g., U.S. Pat. No. 5,685,774); Caribbean Stud® poker (U.S. Pat. No. 4,836,553); Let It Ride® poker (e.g., U.S. Pat. No. 5,288,081); blackjack with Three-card Poker games (e.g., U.S. Pat. Nos. 6,012,719; 6,481,719; and 6,523,831); Four-Card Poker™ games (e.g., US Published Patent Documents 20020195775; 20040061288; 20040217548; 20060267285 and the like), and other variant games and wagering capabilities as disclosed variously in Published US Patent Application documents 20050082760; and U.S. Pat. Nos. 5,494,295 and 5,697,614 (Potter). Some of these games are played with 2, 3, 4, 5, 6 or 7-card player and/or dealer hands, and as standalone games or side bet wagers in underlying games.

U.S. Pat. Nos. 6,206,373 and 6,637,747 (Garrod) describes methods of and apparatus for playing a card game. In one method, the dealer's hand contains a specified card, such as e.g. the ace of spades, displayed face up. From the remainder of the deck each player is dealt two face-down cards. After each player views the two face down cards, each player may act upon his or her hand. The player may be given the option to fold and receive a portion of the original wager back. Alternatively, the player may remain in the game leaving the original wager unchanged. As a further alternative, the player may be given the option to increase the wager up to a determined amount. After making a decision, the five common cards are dealt face up. The common cards are common to each of the players' hands and to the dealer's hand. The dealer is then dealt one card face up to complete the deal. Each player compares his or her best five card hand to the dealer's best five card hand to determine if that player is a winner. Additionally, the player may receive a bonus for certain hands. Further, the player may fold and receive a return based on some portion of, or all of the wager for having one or two of a predetermined card (such as a deuce) in the player's initial two cards.

The most popular game of poker played today is Texas Hold'Em poker. This game is basically played as follows:

In Hold-Em poker, players receive two face-down cards (hole cards) as their personal hand, after which there is a round of betting. Three community cards are then turned simultaneously (called the Flop) and another round of betting occurs. The next two community cards are turned one at a time, with a round of betting after each card (Fourth Street and the River cards). The players may use any five-card combination from among the community cards and their hole cards. A player may even use all of the community cards and no personal cards to form a hand. A traveling dealer button is used to identify a nominative dealer. The usual structure is to use two blinds (compulsory wagers), but it is possible to play the game with one blind, multiple blinds, an ante, or combination of blinds plus an ante. The object of the game is to form best possible five card poker hand, using any combination of hole cards and community cards, or forcing all other players out of the game (e.g., by bluffing) to win the pot.

Each of these references is incorporated herein by reference to assist in understanding poker terms and game and wagering structures.

The success of some of these games has spurred the development of and desire for additional games to be played.

SUMMARY OF THE INVENTION

A casino table variant of Texas Hold 'Em is played as either a player-versus dealer or a player-versus-player game (with no casino/house dealer hand involved in the game) with a player's hand derived from two hole cards (for each player) and three community cards preferably dealt as a two-card flop and a one-card River card. In the player-versus-player variant, which may also be used as a tournament game, a Dealer's button is moved about the table (e.g., clockwise) as in conventional Texas Hold 'Em poker. First cards in each round of play are dealt to a player to the nominal dealer's left. An optional side bet may be placed at the start of each round that pays for low probability hand ranks or card combinations in a player's hole cards. Wagering in the underlying 5-card hand, best three-card hand rank game occurs before the deal (for a blind, if any), after the hole cards are dealt, after the flop and after the River card.

The format of play of the side bet game (which is usually house-banked, as players will not normally assume such risks) may include (in addition to any underlying steps in the play of the underlying casino card game):

- each player placing a side bet to participate in the side bet game;
- a dealer dealing at least one player initial hand of the two hole cards (usually a casino would require two players, as the underlying game is a player-versus-player event);
- comparing a rank of the player's hole card hand to a paytable in the side bet game, wherein the player wins when at least one rank in the paytable is achieved by the player's hole cards; and
- awarding the player a payout when one of the two conditions is met.

DETAILED DESCRIPTION OF THE INVENTION

Figure 1:
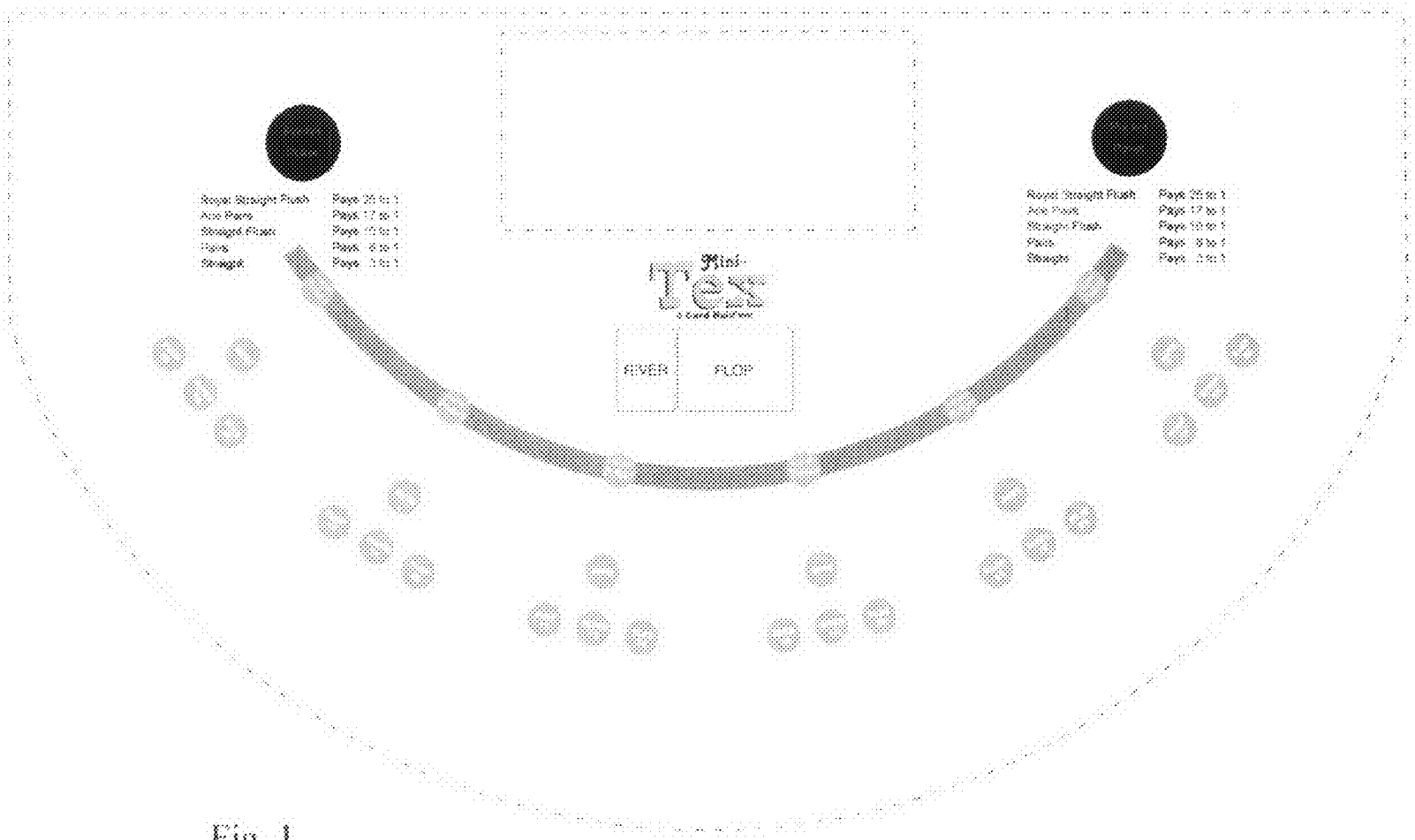
FIG. 1 shows a table layout
Figure 2:
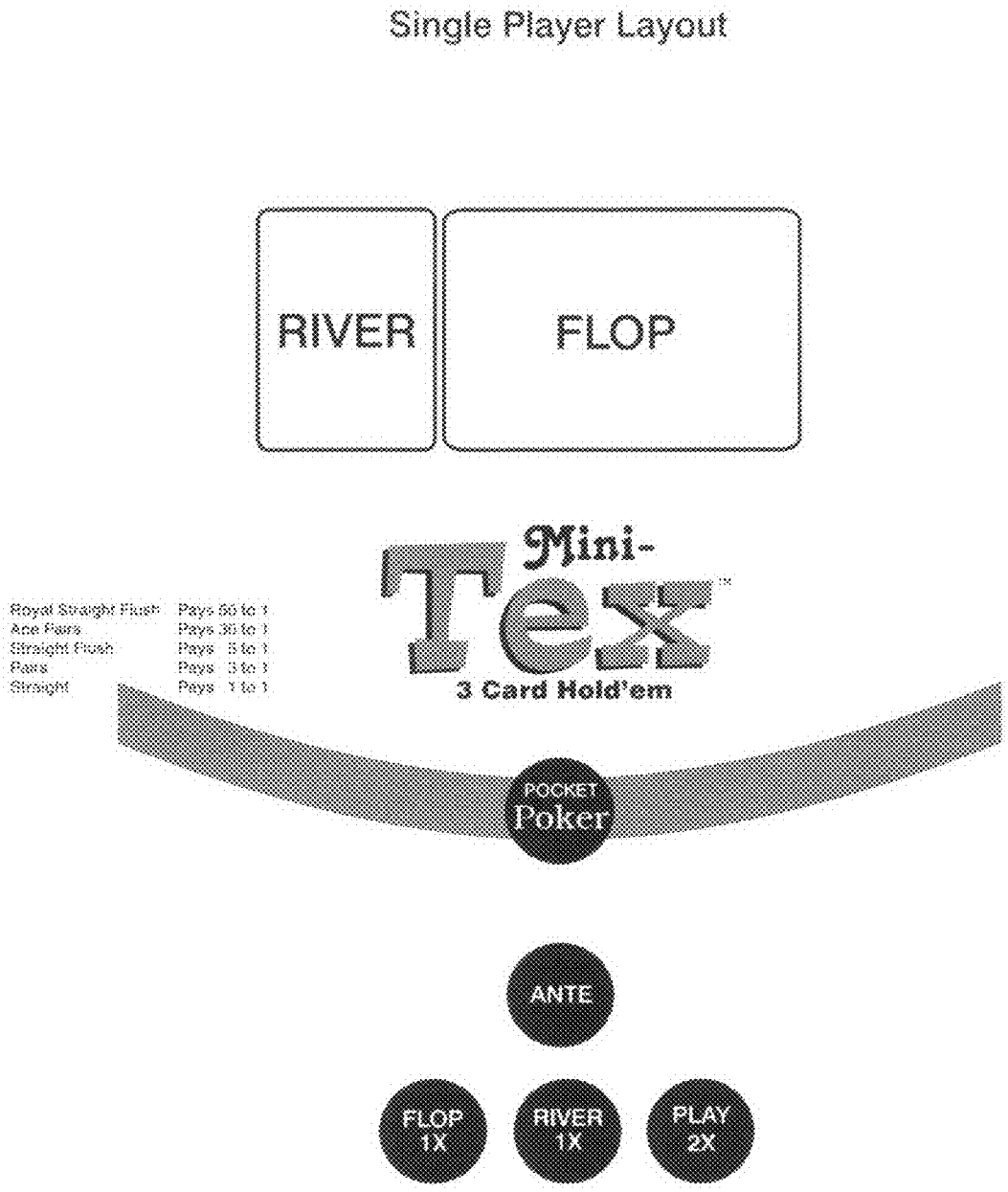
FIG. 2 shows a Single Player layout for wagering and paytable.

The game, herein referred to as Mini-TEX 3-Card Hold-'Em™ game, is played according to the following general description, from which variations in play may be used that embody underlying requirements in play.

As a game to be played as player-versus-player format, there should be at least two players at a table. It is also possible to have a tournament-type event, as is done with Texas Hold-Em poker, with unlimited wagers to eliminate players or by timed numbers of hands with limited wagers to eliminate players with lower totals of money at the conclusion of rounds, as is done in tournament blackjack. A Dealer button is initially randomly assigned to one of the at least two players (e.g., cards may be dealt to all players until a predetermined event, such as first Ace, first Jack, first pair, etc.) occurs. A blind ante may or may not be required in the play of the game, but is optional. Each player preferably must make a fixed Ante wager at the beginning of play of the game. By a fixed Ante wager it is meant that tables will require a fixed sum certain amount for the Ante such as $5.00, $10.00, $25.00 or the like from each player to enter the game. All subsequent game-play wagers (or even the Ante wager may be selected by the dealers in advance of any cards being viewed to be a stake within a range, such that a player may sit at a table where Antes may be varied from hand top hand (as by the nominative dealer or by a random number/value selection from within a range, such as a table being limited to $5.00, $10.00, $15.00 and $20.00 wagers) may be based on multiples or equivalents of the Ante wager, such as 1×, 2×, 3× the Ante wager, which as indicated may be fixed at a table or be varied randomly of by Dealer selection at a table. It is typical that each subsequent wager is a fixed amount or fixed multiple, or as taught in some of Published US Patent Documents 20040061288; 20040217548; and 20060267285, a player may exercise a player-selectable option within a defined range for a subsequent wager such as at least 1× and no more than 5× on a wager after the Ante wager to act as a bluff or a value increasing strategy in the play of a hand. Each subsequent wager may have its own unique range of wagers.

Each player may also place a "Pocket Poker"™ side bet wager on the rank of that player's hole cards, usually to be played against only the house. It is possible for one player to be allowed to place a wager on another player's hole cards, but this can be somewhat confusing for bet placement and identification of the source of wagers, and so is a less preferred embodiment.

After each player that wishes to enter the Mini-TEX 3-Card Hold-'Em™ game in the player-versus-player variant has placed the Ante wager (optional) and/or a small and big blind ante (and the optional side bet wager) is then dealt two hole cards, face-down. These cards are not revealed in the optional side bet game at this time, as the players are competing against each other and would not want cards exposed.

After viewing their respective hole cards, a first player to the left of the dealer (or any other designated position) may make a first wager or stand or fold. Game rules may or may not require at least one player to make a first wager in each round. It is preferred that wagering is optional and that all players may stand without any wagers being made in each round.

After the first wager has been completed and all players are either in the round or out of the round (e.g., by folding or failing to call a bet made by another), the two-card flop is delivered. It is possible to have single card flops and two additional community cards dealt to complete the round (either one at a time with two subsequent rounds of wagering or two at a time, with a single additional round of wagering after wagering on the flop). After the flop is dealt and viewed by the players, players wager in sequence (rules may require that the first active player to the left of the dealer initiate the wagering in each round, or less preferably that a player that initiated the last round of wagering initiates wagering in any next round of wagering). Any player failing to match an earlier wager or to further raise in the game is determined to have folded. It is possible to avoid competitive wagering and reduce bluffing strategy by requiring a specific amount of wager (e.g., a multiple of the Ante wager) for each round of play for a player to remain in the game. For example, with a $5.00 Ante, a player may be required to wager $5.00 after viewing the hole cards, may be required to wager $5.00 or $10.00 to remain in the game, and after viewing the River card(s), each player may be required to wager $5.00 or $10.00 or $15.00 to remain in the game. After all wagers have been placed after the River card(s) has been dealt, player's hands are compared and a winner declared. The rank of cards is preferably the same as with Three-Card Poker® games, assigned to Shuffle Master, Inc., in which from the highest to lowest hand rank, hands are ranked as:

Royal Flush (suited A-K-Q)

Straight Flush (suited cards in order in rank, e.g., 6, 7, 8 of hearts)

Three-of-a-Kind

Straight

Flush

Pair

High rank of cards.

After the player-versus-player competition has been resolved, the house will inspect the individual player hands that have placed the Pocket Poker wager and determine if any of the wagers may be paid off according to a paytable. A typical paytable could be similar to paytables for Three-Card Poker® games assigned to Shuffle Master, Inc. such as:

| | |
|---|---|
| Royal Flush (suited A-K-Q, which for bonus purposes may or may not be distinguished from any straight flush) | 30-50:1 |
| Straight Flush (suited cards in order in rank, e.g., 6, 7, 8 of hearts) | 25-40:1 |
| Three-of-a-Kind | 20-40:1 |
| Straight | 3-8:1 |
| Flush | 2-8:1 |
| Pair | 1-4:1 |
| 2 card Royal Straight Flush | 40-50 to 1 |
| Pair of Aces | 20-30 to 1 |
| 2 card Straight Flush | 4-5 to 1 |
| Any Pair | 2-3 to 1 |
| 2 card Straight | 1 to 1 |

The payout may be adjusted to either reflect actual probabilities or to pay higher amounts for certain higher frequency events, such as by paying 3:1 for a pair and 1:1 for a flush.

In the preferred method of play of the game, either for the underlying player-versus-player event and/or for the Pocket Poker™ side bet wager, rules may or may not require that at least one hole card from a player's hand must be used in forming each player's hand. This would reduce the likelihood of ties and reduce the likelihood of every player receiving a high ranked hand because the three community cards form a high rank hand.

As a player-versus-dealer game, the game may be played with at least one player at a table with a casino real dealer or virtual dealer (on an electronic system). A Dealer button need not be assigned as there is a single dealer, unless as in Pai Gow Poker, a player may elect to be a banker. A blind ante is not required in the play of the player-versus-dealer game, but is optional. Each player preferably must make a fixed Ante wager at the beginning of play of the game. By a fixed Ante wager it is meant that casino tables will require a fixed sum certain amount for the Ante such as $5.00, $10.00, $25.00 or the like from each player to enter the game. Subsequent wagers after the ante may be compulsory to remain in the game or a stand may be allowed on previous wagers. Typically, each subsequent wager after the ante must be made for the player to remain in the game. It is possible to allow players to remain in the game with only one wager, and usually one particular wager that a player may be allowed to stand on (not have to make an additional wager). This could be the first wager (after receiving the hole cards), the second wager (after receiving the flop), or the third wager, after receiving an at least second set of community card(s). All subsequent gameplay wagers may be based on multiples or equivalents of the Ante wager, such as 1×, 2×, 3× the Ante wager. It is typical that each subsequent wager is a fixed amount, or as taught in some of Published US Patent Documents 20040061288; 20040217548; and 20060267285, a player may exercise a player-selectable option within a defined range for a subsequent wager such as at least 1× and no more than 5× on a wager after the Ante wager. Each subsequent wager may have its own unique range of wagers.

Each player may also place a "Pocket Poker"™ side bet wager on the rank of that player's hole cards. It is possible for one player to be allowed to place a wager on another player's hole cards, but this can be somewhat confusing for bet placement and identification of the source of wagers, and so is a less preferred embodiment.

After each player that wishes to enter the Mini-TEX 3-Card Hold-'Em™ game has placed the Ante wager (and/or the optional side bet wager) is then dealt two hole cards, face-down. These cards may be revealed in the optional side bet game at this time, as the players are not competing against each other and exposure of cards has no effect on play. It is therefore an optional house rule or an electable decision on the part of players as to whether or not cards are to be displayed.

After viewing their respective hole cards, In the preferred method the first player to the left of the dealer (or any other designated position) may must make a first wager of 1× their ante this wager is known as the flop bet, or stand or fold. In an electronic rendition, players may make their elections at any time after they have their cards and in any order. Game rules may or may not require at least one player to make a first wager in each round or may allow player to wager 2× to 5× the ante. It is preferred that wagering is optional and that all players may stand without any wagers being made in each round.

After the first wager has been completed and all players are either in the round or out of the round (e.g., by folding or failing to call a bet) made by another). In the preferred method (for example) 2 cards are turned over this is known as the flop two-card flop is delivered these cards are community cards and may be used by players and dealer for their final 3 card hand. It is possible to have single card flops and two additional community cards dealt to complete the round (either one at a time with two subsequent rounds of wagering or two at a time, with a single additional round of wagering after wagering on the flop). After the flop is dealt and viewed by the players, In the preferred method players wager in sequence 1× their ante this wager is known as the river bet. Game rules may or may not require a second wager or may allow player to wager 2× to 5× the ante. (rules may require that the first active player to the left of the dealer initiate the wagering in each round, or less preferably that a player that initiated the last round of wagering initiates wagering in any next round of wagering). Any player failing to bet 1× their ante match an earlier wager or to further raise in the second round of betting is determined to have folded. It is possible to avoid competitive wagering and reduce bluffing strategy by requiring a specific amount of wager (e.g., a multiple of the Ante wager) for each round of play for a player to remain in the game. For example, with a $5.00 Ante, a player may be required to wager $5.00 after viewing the hole cards, may be required to wager $5.00 or $10.00 to remain in the game, and after viewing the River card(s), each player may be required to wager $5.00 or $10.00 or $15.00 to remain in the game. After all wagers have been placed after the second wager has been completed and all players are either in the round or out of the round. In the preferred method 1 card is turned over this card is known as the River card(s) This card is a community card and may be used by players and dealer for their final 3 card hand. After the River card is dealt and viewed by the players, In the preferred method players wager 2× their ante this wager is known as the play bet. Game rules may or may not require a third wager in each round or 3× to 5× the ante. Any player failing to bet 2× their ante in the third round of betting is determined to have folded has been dealt, player's hands are compared and a winner declared.

In the preferred method after all players wager or fold the dealer will compare player hands that wagered with the dealer hand, player or dealer with the highest ranking hand win. If player wins and dealers hand qualifies with a pair or higher, player is paid 1 to 1 on the ante, flop, river and play bets. If dealer doesn't qualify with a pair or higher, player will be paid 1 to 1 on the ante, flop and river bets only. If dealer has highest hand dealer will collect all bets. Player qualifying hand may vary to a higher or lower hand ranking to adjust house odds.

Hands are Ranked as:

Royal Flush (suited A-K-Q)

Straight Flush (suited cards in order in rank, e.g., 6, 7, 8 of hearts)

Three-of-a-Kind

Straight

Flush

Pair

High rank of cards.

After the player-versus-dealer competition has been resolved, the house will inspect each player's 2 hold cards of all players that wagered on the Pocket Poker side bet (e.g., individual player hands that have placed the Pocket Poker wager) and determine if any of the wagers may be paid off according to a paytable. A typical paytable could be similar to what is shown below.

| | |
|---|---|
| 2 card Royal Straight Flush | 40-50 to 1 |
| Pair of Aces | 20-30 to 1 |
| 2 card Straight Flush | 4-5 to 1 |
| Any Pair | 2-3 to 1 |
| 2 card Straight | 1 to 1 |

The payout may be adjusted to either reflect actual probabilities or to pay higher amounts for certain higher frequency events, such as by paying 3:1 for a pair and 1:1 for a flush or straight In the preferred method of play of the game version, either for the underlying player-versus-dealer event and/or for the Pocket Poker™ side bet wager, rules may or may not require that at least one hole card from a player's hand must be used in forming each player's and dealer's hand. This would reduce the likelihood of ties and reduce the likelihood of every player and the dealer receiving a high ranked hand because the three community cards form a high rank hand. It is also a preferred rule that for all wagers to be in play and to be won by a player's hand beating the dealer's hand that the dealer's hand have an at least minimum rank. In Caribbean Stud® poker, such a minimum rank is at least an Ace-King ranked hand, which may be used in the present game also. Another minimum rank could be any selected at least high card ranked dealer hand, any pair, or at least a pair of a minimum rank (e.g., a pair of 4s. These variations can be used to adjust house hold or retention in the play of the game. If the dealer hand does not qualify, the player may be paid on only one wager or less than all wagers. The wagers paid on may be only the Ante, only the first wager (after seeing the hole cards), only the second wager (after seeing the flop, which may be the largest required wager, or any combination of the two wagers.

An odds and probability analysis in the play of the game of Mini-TEX 3-Card Hold-'Em™ games is as follows, when requiring each player to use at least one hole card in forming each player's hand.

| Outcome | Pays | Combinations | Probability | Frequency | Return |
|---|---|---|---|---|---|
| Fold after seeing 2 hole cards | −1 | 1,144,130,400 | 0.013575 | 1 in 73.7 | −0.013575 |
| Fold after 2 community cards | −2 | 5,394,691,584 | 0.064006 | 1 in 15.6 | −0.128012 |
| Fold after 3 community cards | −3 | 10,285,213,416 | 0.122030 | 1 in 8.2 | −0.366090 |
| Dealer does not qualify (any pair) | 3 | 15,371,719,056 | 0.182379 | 1 in 5.5 | 0.547138 |
| Wins | 3 | 24,416,000,664 | 0.289686 | 1 in 3.5 | 1.448432 |
| Ties | 0 | 2,047,940,652 | 0.024298 | 1 in 41.2 | 0000000 |
| Loses | −5 | 25,624,577,028 | 1 in 3.3 | 1 in 3.3 | −1.520128 |
| Total | | 84,284,272,800 | 1.0000 | | 0.032235 |

Other variations and options within the skill of the artisan may be practiced in the play or design of the game. For example, additional side bets (bad beat bets, progressive jackpot bets) may be available, cards and/or the dealer may be virtual cards, bonus event cards may be added to the deck, wild cards may be used, odds varied, paytables varied and the like. The payouts for ranked three-card poker hands from five cards will usually be varied (lowered) from those typically provided in the commercial version of Three-Card Poker® game of Shuffle Master, Inc. because the three-card hand in this game is being made from a pool of four or five cards and the probability of higher ranking hands increases, so the odds must be lowered.

It is also possible to have a display device (e.g., screen, monitor LED, liquid crystal display, plasma screen, etc.) that is fed by data from a computer or microprocessor or other image source to show the applicable or dynamic pay table for the number of players involved in the payout for the hands at any given point in time. For example, the display may show separate screen for 2 player, 3 player, 4 player, 5 player, 6 player and 7 player bonus events, each screen having different odds and payouts. Automated equipment indicating the number of wagers placed, the number of players entered, the rank of the hand, and other factors can be provided. For example, camera, scanners, digital readers, and software interpreting the data such as that provided in U.S. Pat. Nos. 6,313,871; 6,460,848; 6,126,166; 5,941,769; and the like could be used to assist in automating the reading of cards, ranks, wagers, and the number of players.

What is claimed:

1. A method of playing a playing card wagering game in which a player hand competes against at least a dealer hand at a table according to a three-card poker rank of the player hand wherein:

at least one player places a first ante wager on the playing card wagering game;

each player and the dealer receives exactly two physical playing cards as hole cards viewed by only the player receiving hole cards and each player evaluating respective hole cards, while the dealer hole cards remain concealed;

each player placing a second wager on the card wagering game to remain in the game or not placing a second wager and folding as a first round of wagering;

after the first round of wagering, a flop of physical playing cards as an only single set of physical playing cards as community cards is provided for all players and the dealer to use in combination with respective hole cards to determine respective player at least intermediate hand rank;

each player placing a third wager on the card wagering game to remain in the game or not placing a third wager and folding as a second round of wagering after viewing the flop of the only single set of community cards;

after the second round of wagering, a second at least one physical playing card as a second set of community cards is provided for all players and the dealer to use in combination with respective hole cards and the flop to determine respective player at least intermediate hand rank;

each player placing a fourth wager on the underlying card game to remain in the game or not placing a fourth wager and folding as a third round of wagering after viewing the second at least one physical playing card as a second set of community cards;

after an ultimate number of exactly three physical playing cards as community cards have been separately provided as sets for use by each player and the dealer, and wagering has been completed, comparing player hand ranks of only three-card poker rank against a dealer hand rank of only three-card poker rank to determine a player or players with highest rank of hand as compared to the dealer, and paying such highest rank of hand against the dealer players at least 1:1 on all wagers on the card wagering game.

2. The method of claim 1 wherein at the time the ante wager is placed, each player may make an optional side bet wager against a paytable based on the player 2 hold cards on expectation of a high-rank two-card poker hand at conclusion of a round of play, and if any player has placed an optional side bet wager, such player best rank of two-card poker hand is compared to a paytable and if the such player best rank of two-card poker hand meets predetermined ranks on the paytable, such player side bet wager is paid according to the paytable.

3. The method of claim 2 wherein community cards are first dealt two-at-a-time and secondly dealt one-at-a-time so that there are three rounds of wagering.

4. The method of claim 2 wherein each hand rank for a player hand is required to include at least one respective player hole cards.

5. The method of claim 1 wherein community cards are dealt once one-at-a-time and once two-at-a-time so that there are three rounds of wagering for a total of three community cards at conclusion of a round of play and wherein each hand rank for a player hand is required to include at least one respective player hole cards.

6. The method of claim 5 wherein each round of wagering is required to be a specific multiple of the Ante wager.

7. The method of claim 5 wherein each round of wagering is required to be a specific multiple of the Ante wager, and wagers for different rounds of at least two wagers of the three rounds of wagering are different multiples of the Ante wager.

8. The method of claim 7 wherein at least one of the three wagers is required to be 1× the Ante wager and at least one other of the three wagers is required to be 2× the Ante wager.

9. The method of claim 8 wherein each hand rank for a player hand is required to include at least one respective player hole cards.

10. The method of claim 5 wherein each hand rank for a player hand is required to include at least one respective player hole cards.

11. The method of claim 1 wherein community cards are first dealt one-at-a-time and secondly dealt two-at-a-time so that there are three rounds of wagering and wherein each hand rank for a player hand is required to include at least one respective player hole cards.

12. The method of claim 1 wherein community cards are first dealt two-at-a-time and secondly dealt one-at-a-time so that there are three rounds of wagering.

13. The method of claim 1 wherein each hand rank for a player hand is required to include at least one respective player hole cards.

14. A method of playing a playing card wagering game in which a player hand competes against at least one other player hand at a table according to a three-card poker rank of the player hand wherein:

at least two players place a first ante wager on the playing card wagering game;

each player exercises an option as to whether or not to place a second wager on at least one side bet event;

each player receives exactly a single set of two physical playing cards as hole cards viewed by only the player receiving hole cards and evaluating respective hole cards;

each player placing a second wager to remain in the game or not placing a second wager and folding as a first round of wagering;

after the first round of wagering, a flop of a single set of physical playing cards as community cards is provided for all players to use in combination with respective hole cards to determine respective player at least intermediate hand rank;

each player placing a second wager to remain in the game or not placing a second wager and folding as a second round of wagering after viewing the flop of the single set of physical playing cards as community cards;

after the second round of wagering, a second at least one single set of a physical playing card as community card is provided for all players to use in combination with respective hole cards and the flop to determine respective player at least intermediate hand rank;

each player placing a third wager to remain in the game or not placing a third wager and folding as a third round of wagering after viewing the second at least one single set of a physical playing card as community cards;

after an ultimate number of exactly three community cards have been provided, and wagering has been completed, comparing player hand ranks of only three-card poker rank to determine a player or players with highest rank of hand as compared to all other players, and paying such highest rank of hand players 1:1 on all wagers except for the optional side bet wager; and if any player has placed an optional side bet wager based on the player two hole cards, such player best rank of two-card poker hand is compared to a paytable and if the such player best rank of two-card poker hand meets predetermined ranks on the paytable, such player side bet wager is paid according to the paytable.

15. The method of claim 14 wherein community cards are dealt once one-at-a-time and once two-at-a-time so that there are three rounds of wagering for a total of three community cards at conclusion of a round of play.

16. The method of claim 14 wherein community cards are first dealt one-at-a-time and secondly dealt two-at-a-time so that there are three rounds of wagering.

17. The method of claim 14 wherein community cards are first dealt two-at-a-time and secondly dealt one-at-a-time so that there are three rounds of wagering and each hand rank for a player hand is required to include at least one respective player hole cards.

18. The method of claim 14 wherein each round of wagering is required to be a specific multiple of the Ante wager.

19. The method of claim 14 wherein each round of wagering is required to be a specific multiple of the Ante wager, and wagers for different rounds of at least two wagers of the three rounds of wagering are different multiples of the Ante wager.

20. The method of claim 19 wherein at least one of the three wagers is required to be 1× the Ante wager and at least one other of the three wagers is required to be 2× the Ante wager.

21. The method of claim 14 wherein each hand rank for a player hand is required to include at least one respective player hole cards.

22. A method of playing a playing card wagering game in which a player hand competes against at least a dealer hand at an electronic gaming table according to a three-card poker rank of the player band wherein:

at least one player places a first ante wager on the playing card wagering game;

each player and the dealer receives exactly two virtual playing cards on a display device from a processor as hole cards viewed by only the player receiving hole cards and each player evaluating respective hole cards, while the dealer hole cards remain concealed;

each player placing a second wager on the card wagering game to remain in the game or not placing a second wager and folding as a first round of wagering;

after the first round of wagering, a flop of virtual playing cards as community cards is provided for all players and the dealer to use in combination with respective hole cards to determine respective player at least intermediate hand rank;

each player placing a third wager on the card wagering game to remain in the game or not placing a third wager and folding as a second round of wagering after viewing the flop of community cards;

after the second round of wagering, a second at least one virtual playing card as a community card is provided for all players and the dealer to use in combination with respective hole cards and the flop to determine respective player at least intermediate hand rank;

each player placing a fourth wager on the underlying card game to remain in the game or not placing a fourth wager and folding as a third round of wagering after viewing the second at least one community cards;

after an ultimate number of exactly three virtual playing cards have been separately provided as sets of community cards for use by each player and the dealer, and wagering has been completed, comparing player hand ranks of only three-card poker rank against a dealer hand rank of only three-card poker rank to determine a player or players with highest rank of hand as compared to the dealer, and paying such highest rank of hand against the dealer players at least 1:1 on all wagers on the card wagering game.

* * * * *